US009151123B2

(12) United States Patent
Portman

(10) Patent No.: US 9,151,123 B2
(45) **Date of Patent: *Oct. 6, 2015**

(54) APPARATUS AND METHODS FOR PROVIDING TUBING INTO A SUBSEA WELL

(71) Applicant: Baker Hughes Incorporated, Houston, TX (US)

(72) Inventor: Lance Nigel Portman, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/245,793

(22) Filed: Apr. 4, 2014

(65) Prior Publication Data

US 2014/0216752 A1 Aug. 7, 2014

Related U.S. Application Data

(63) Continuation of application No. 13/109,422, filed on May 17, 2011, now Pat. No. 8,720,582.

(60) Provisional application No. 61/346,323, filed on May 19, 2010.

(51) Int. Cl.
*E21B 19/22* (2006.01)
*E21B 19/00* (2006.01)

(52) U.S. Cl.
CPC ..... *E21B 19/22* (2013.01); *E21B 19/002* (2013.01)

(58) Field of Classification Search
CPC ..... E21B 19/002; E21B 19/22
USPC ..... 166/338, 339, 343, 344, 346, 348, 351, 166/355, 77.2, 77.3, 71.1
See application file for complete search history.

(56) References Cited

U.S. PATENT DOCUMENTS

| | | | | |
|---|---|---|---|---|
| 4,655,291 | A | 4/1987 | Cox | |
| 4,899,823 | A * | 2/1990 | Cobb et al. | 166/351 |
| 4,986,360 | A | 1/1991 | Laky et al. | |
| 5,002,130 | A | 3/1991 | Laky | |
| 5,547,314 | A | 8/1996 | Ames | |

(Continued)

FOREIGN PATENT DOCUMENTS

| | | | |
|---|---|---|---|
| GB | 2379947 | A | 3/2003 |
| WO | 98/14686 | A1 | 4/1998 |

OTHER PUBLICATIONS

Christopher Hoen and Svein Haheim, Coiled Tubing and Vessel Motions for Riserless Coiled Tubing Systems, SPE 89347, SPE/ICoTA Coiled Tubing Conference, Houston, Texas, Mar. 23-24, 2004, pp. 1-10.

(Continued)

*Primary Examiner* — James G Sayre
(74) *Attorney, Agent, or Firm* — E. Randall Smith; Jones & Smith, LLP

(57) ABSTRACT

In some embodiments, apparatus useful for providing tubing into an underwater well includes at least one surface injector and at least one underwater injector. The surface injector is adapted and arranged to control the movement of the tubing into and out of the underground well below the sea floor during normal operations. At least one surface injector and/or underwater injector is arranged and adapted to maintain the tubing in substantial tension between the surface and underwater injectors.

25 Claims, 5 Drawing Sheets

(56) References Cited

U.S. PATENT DOCUMENTS

| | | | | |
|---|---|---|---|---|
| 5,738,173 | A | 4/1998 | Burge et al. | |
| 5,775,417 | A | 7/1998 | Council | |
| 5,823,267 | A | 10/1998 | Burge et al. | |
| 5,845,708 | A | 12/1998 | Burge et al. | |
| 5,850,874 | A | 12/1998 | Burge et al. | |
| 5,875,850 | A | 3/1999 | Burge et al. | |
| 5,890,534 | A | 4/1999 | Burge et al. | |
| 6,032,744 | A | 3/2000 | Burge et al. | |
| 6,116,345 | A | 9/2000 | Fontana et al. | |
| 6,276,454 | B1 | 8/2001 | Fontana et al. | |
| 6,386,290 | B1 | 5/2002 | Headworth | |
| 6,691,775 | B2 | 2/2004 | Headworth | |
| 7,111,689 | B2 | 9/2006 | Wise et al. | |
| 7,185,708 | B2 | 3/2007 | Wood et al. | |
| 7,431,092 | B2 * | 10/2008 | Haheim et al. | 166/343 |
| 8,720,582 | B2 * | 5/2014 | Portman | 166/348 |
| 2003/0155127 | A1 | 8/2003 | Carlsen | |
| 2004/0094306 | A1 | 5/2004 | Goode et al. | |
| 2006/0124314 | A1 | 6/2006 | Haheim et al. | |
| 2007/0284113 | A1 | 12/2007 | Haheim | |
| 2008/0230228 | A1 | 9/2008 | Askeland | |
| 2008/0265081 | A1 | 10/2008 | Laun et al. | |
| 2008/0296025 | A1 | 12/2008 | Inderberg et al. | |

OTHER PUBLICATIONS

Svein Haheim et al., Riserless Coiled-Tubing Well Intervention, OTC 15179, 2003 OTC, Houston, Texas, May 5-8, 2003, pp. 1-10.

* cited by examiner

APPARATUS AND METHODS FOR PROVIDING TUBING INTO A SUBSEA WELL

This application is a continuation application of U.S. patent application Ser. No. 13/109,422 filed May 17, 2011 and Entitled "Apparatus and Methods for Providing Tubing Into a Subsea Well", which claims priority to U.S. Provisional Patent Application Ser. No. 61/346,323 filed May 19, 2010 and Entitled "Apparatus and Methods for Providing Tubing Into a Subsea Well", the disclosures of which are hereby incorporated by reference herein in its entirety.

FIELD OF THE INVENTION

Some embodiments of the present disclosure relate to the use of a tubing injection system in connection with underwater well, such as a subsea hydrocarbon production well.

BACKGROUND

In various phases of hydrocarbon recovery operations, a tubing injector is commonly used to insert a tubing into the well for performing various downhole services. Conducting tubing intervention in underwater or subsea wells typically warrants the use of a tubing injector at the subsea wellhead. The underwater disposition of the injector and the significant distance that may exist to the sea floor pose unique challenges in conducting effective and efficient subsea tubing intervention operations.

Various presently known injector systems and techniques for subsea tubing intervention are believed to have one or more drawbacks. For example, in some known existing systems, the sea-floor injector is utilized as the primary injector for moving the tubing into and out of the well. In such instances, the operation of the sea-floor injector will need to be controlled from the surface. Accordingly, the submerged injector will typically require substantial valve and control components, instrumentation that can be monitored from the surface and significant umbilical support (communication/control lines) from the surface. As such, the submerged injector will likely be heavy and cumbersome, requiring special equipment for deployment and rendering retrieval difficult or impractical. Furthermore, a multitude of components that are subject to malfunction, failure and maintenance will be underwater or located on the injector at the sea floor. Remotely accessing, repairing or replacing these components will be time consuming, expensive and difficult or impossible.

It should be understood that the above-described discussion is provided for illustrative purposes only and is not intended to limit the scope or subject matter of this disclosure or any related patent application or patent. Thus, none of the appended claims or claims of any related patent application or patent should be limited by the above discussion or required to address, include or exclude the above-cited examples, features and/or disadvantages merely because of their mention above.

Accordingly, there exists a need for improved systems, apparatus and methods capable of providing a tubing into an underwater well having one or more of the attributes, capabilities or features described below or evident from the appended drawings.

BRIEF SUMMARY OF THE DISCLOSURE

In some embodiments, the present disclosure involves apparatus for injecting tubing from a structure located proximate to the surface of a body of water into a well extending into the earth below the water and sea floor. The apparatus includes at least one surface injector associated with the structure, engaged with the tubing and positionable proximate to the surface of the water. The surface injector is adapted and arranged to control movement of the tubing into and out of the underground well below the sea floor during normal operations. At least one underwater injector is engaged with the tubing, deliverable on the tubing from the structure to the well, releasably engageable with the well and arranged and adapted to apply limited downwardly-directed pushing forces and limited upwardly-directed pulling forces to the tubing. At least one of the surface and/or underwater injectors is arranged and adapted to maintain the tubing in substantial tension between the surface and underwater injectors. The tubing and underwater injector(s) are delivered to the well without the use of one or more risers extending from the structure to the well.

In various embodiments, the present disclosure involves apparatus for providing coiled tubing into a subsea hydrocarbon production well from a waterborne vessel on the surface of the sea. The apparatus includes at least one master injector carried by the vessel, having a known weight, positionable proximate to the surface of the water and engaged with the coiled tubing. The master injector is adapted and arranged to control the movement of the tubing into and out of the underground well below the sea floor during normal operations. At least one slave injector is engaged with the coiled tubing, deliverable on the coiled tubing from the vessel to the well and configured to be repeatedly deployable to and from the well. The weight of each slave injector is less than the weight of each master injector. At least one master and/or slave injector is arranged and adapted to maintain the tubing in substantial tension between the master and slave injectors. The coiled tubing and slave injector are delivered to the well without the use of one or more risers extending from the vessel to the well.

In many embodiments, the present disclosure involves apparatus for providing coiled tubing into a subsea hydrocarbon production well from a waterborne vessel on the surface of the sea. The apparatus includes at least one master injector carried by the vessel, positionable proximate to the surface of the water and engaged with the coiled tubing. The master injector is arranged and adapted to alone control movement of the coiled tubing into and out of the underground well below the sea floor. At least one slave injector is engaged with the coiled tubing and delivered on the coiled tubing from the vessel to the well. Each slave injector is configured to be operated at a power level that is less than approximately one-half of the operating power level of each master injector. The coiled tubing and slave injector are delivered to the well without the use of one or more risers extending from the vessel to the well.

The present disclosure also includes embodiment of methods of providing tubing into a subsea well from a floating structure. In some embodiments, a first end of the tubing is extended through at least one master injector carried on the structure. At least one slave injector is suspended at the first end of the tubing. The slave injector is delivered to the well by lowering the tubing into the water without the use of one or more risers extending from the structure to the well. The slave injector is engaged with the well. Tension is maintained on the tubing between the master and slave injectors. The mater injector is selectively operated to control movement of the tubing into and out of the underground well.

Accordingly, the present disclosure includes features and advantages which are believed to enable it to advance underwater tubing intervention technology. Characteristics and potential advantages of the present disclosure described above and additional potential features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
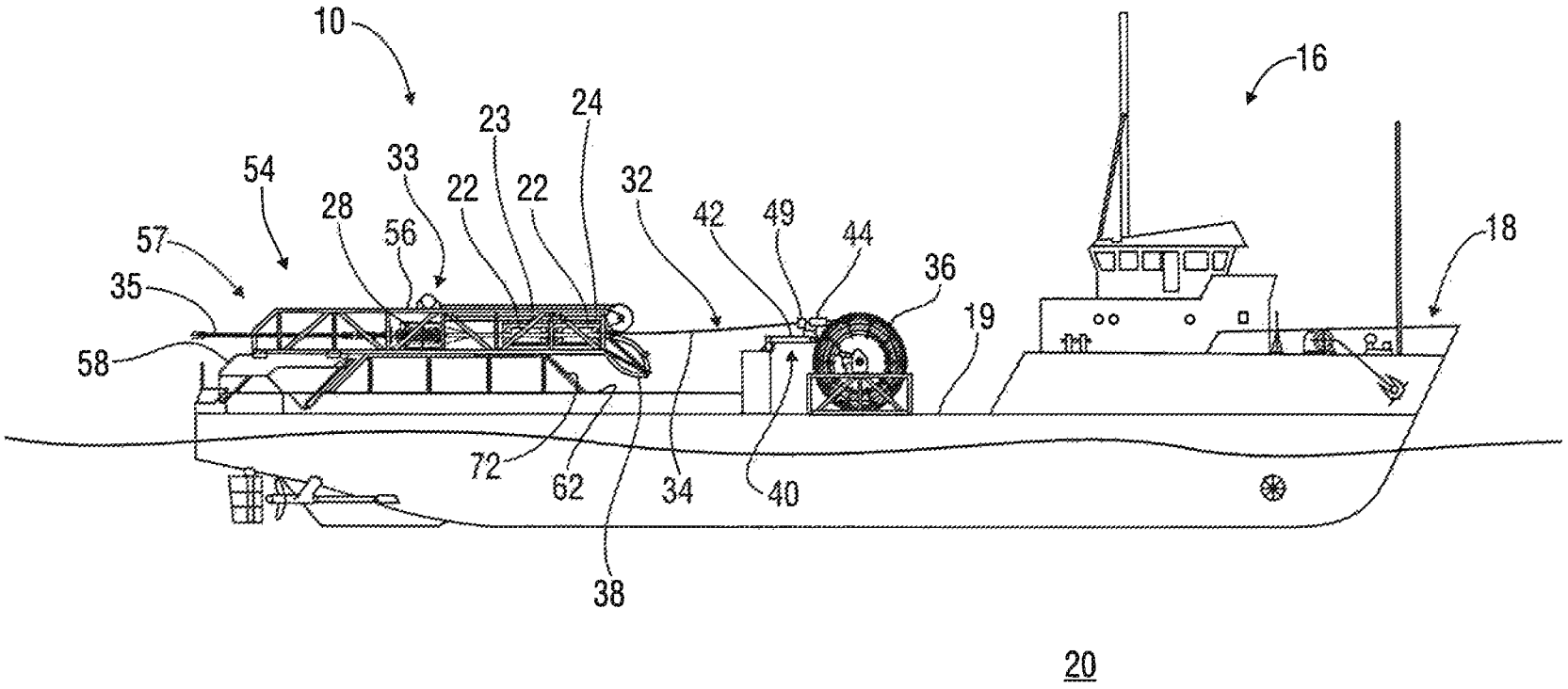
FIG. 1 is a side view of a waterborne vessel carrying a tubing intervention system that includes at least one surface injector and at least one subsurface injection shown disposed upon a carriage of an erectable mast assembly in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced in the appended figures with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged", "carried" and the like, and variations thereof, as used herein and in the appended claims are intended to mean either an indirect or direct connection or relationship. For example, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, a tubing intervention system 10 in accordance with an embodiment of the present disclosure is carried on a structure 16, such as a waterborne vessel 18, shown deployed in a body of water 20. In other embodiments, the structure 16 may be a floating platform (not shown) or any other desired carrier or arrangement of carriers. The body of water 20 may be an ocean, sea or bay, or take any other form. Thus, the form and other characteristics of the body of water 20 are not limiting upon the present disclosure or appended claims. For simplicity, the term "sea" is used herein to refer to the body of water 20 (in any form) and should not be considered as limiting.

The illustrated system 10 includes at least one surface injector 22 and at least one underwater injector 28. The surface injector 22 remains on or near the structure 16 throughout normal operations, while the underwater injector 28 is lowered into the water to a wellhead (not shown) at the sea floor. In some embodiments, one or more surface injector 22 may remain mounted to or suspended from the structure 16 above the surface of the water during operations. Other embodiments may involve submerging one or more surface injector 22 into the water generally at a desired shallow depth near the water's surface (e.g. up to 50 feet in the water) at some time during operations. Thus, the phrase "proximate to the surface of the water" and variations thereof when used in reference to the position of a surface injector 22 means located somewhere above the surface of the water on or suspended from the vessel 16 or submerged at a generally shallow depth in the water during typical operations.

The injectors 22, 28 are engaged with a tubing 32 and are useful to insert and remove the tubing 32 and any equipment (e.g. bottomhole assembly) that may be carried by the tubing 32 into and out of an underground well accessible through the wellhead at the sea floor (not shown). In this example, the tubing 32 is conventional coiled tubing 34, which is useful to carry a bottomhole assembly (not shown) for well servicing operations, as is and becomes further known. However, the present disclosure is not limited to use with coiled tubing 34 and may be used with any other form of suitable tubing 32 and other equipment.

In the present embodiment, it is desirable to generally maintain substantial tension upon the tubing 32 between the injectors 22, 28 during operations. For example, in some situations, maintaining tension on the coiled tubing 34 may avoid undesirable kinking of the tubing 34 near the sea floor and may assist in rendering the system 10 and/or tubing 32 more tolerant of sea currents. As used herein, the term "substantial" and variations thereof means completely, but allowing for some variation therefrom that may be expected or encountered during typical operations, depending upon the particular usage or application being referenced. However, there may be embodiments or instances where it is not desirable or possible to maintain tension on the tubing 32.

Still referring to FIG. 1, the surface injector 22 is configured, arranged and powered as the "master" or "primary" injector of the system 10 to control the up and down movement, position, speed of movement and automatic breaking of the tubing 32 during normal operations, as are and become further known. Any suitable tubing injector may be used as the surface injector 22. The illustrated surface injector 22 is generally operated and controlled similarly to a standard land injector unit, as is and becomes further known. A few examples of presently commercially available tubing injectors that may be configured or adapted for use as the surface injector 22 in connection with some embodiments of the present disclosure are the Hydra-Rig® HR 580 or HR 680 models.

Still referring to FIG. 1, the illustrated system 10 includes two essentially identical surface injectors 22, referred to herein as the first and second surface injectors 23, 24. In this embodiment, the second surface injector 24 is provided for 100% redundancy, runs in tandem with the first injector 23 and is always engaged. Thus, if one injector 23, 24 fails, the other injector 23, 24 will take over to provide the necessary injector functions. In some applications, for example, each injector 23, 24 may be a standard land injector unit having a pull rating of 80,000 lbs. It should be understood, however, that multiple surface injectors 22 may not be included. Further, when multiple surface injectors 22 are included, any desired quantity may be used and they need not be identical. It should also be noted that the system 10 may likewise include one or more identical or non-identical underwater injectors 28, if desired.

The underwater injector 28 is configured, arranged and energized to provide limited functions. For example, the illustrated underwater injector 28 is a "slave" or "secondary" injector of the system 10 that is configured and used to apply downwardly-directed pushing forces and upwardly-directed pulling forces to the tubing 32 without controlling the movement of the tubing 32. The underwater injector 28 of this embodiment possesses relatively low tubing push/pull power capacity and provides relatively low traction force on the tubing 32. Consequently, the illustrated injector 28 is relatively simple and lightweight and is easy to move up and down from the structure 16 to the well. The term "relatively", as used herein in regards to the underwater injector 28 or its components or capabilities, means as compared to a standard or conventional full-capacity land injector unit or the surface injector 22. However, in other embodiments, the underwater injector 28 may not be limited as described above.

If desired, the underwater injector 28 may be configured and used to apply only such approximate downwardly-directed pushing force to the tubing 32 as may be necessary during operations to overcome wellhead pressure and well friction occurring when inserting the tubing 32 into the well and to maintain tension on the tubing 32 above the underwater injector 28. The exemplary underwater injector 28 is thus instrumental in snubbing or stabbing high pressure wells, changing out sub-surface safety valves (not shown) or other equipment or other activities at shallow depths in the well (e.g. up to 6,000 feet in the well in some applications). Also if desired, the underwater injector 28 may be configured and used to apply only such approximate upwardly-directed pulling force to the tubing 32 as may be necessary to overcome the weight of the tubing 32 above the injector 28 when removing the tubing 32 from the well.

Still referring to FIG. 1, the underwater injector 28 may possess and/or be operated at any desired power level. In the illustrated embodiment, the injector 28 is operated at a low power. For example, the operating power level or rated power of the underwater injector 28 may be less than that of each surface injector 22. In some arrangements, for example, the underwater injector 28 may operate at a power level or have a rated power that is less than approximately one-half that of each surface injector 22. There may even be situations where the operating power level or rated power of the injector 28 is less than approximately one-third that of each injector 22.

Any suitable injector may be used as the underwater injector 28 (sometimes referred to as the "sea-floor" injector). For example, a standard land injector unit designed for engaging 1½" coiled tubing injector may be stripped-down or modified to be used as the underwater injector 28 of the tubing intervention system 10 with 2" or 2⅜" coiled tubing. One particular example of a presently commercially available tubing injector that may be configured or modified for use as the underwater injector 28 in connection with some embodiments of the present disclosure is the Hydra-Rig® HR 635 model. Additional information on features or types of tubing injectors and/or related equipment that may be useful or modified for use in connection with the surface injector 22 and/or underwater injector 28 of some embodiments of the present disclosure is available in publicly accessible documents, such as U.S. Pat. No. 4,655,291 to Cox, entitled "Injector for Coupled Pipe" and issued on Apr. 7, 1987, U.S. Pat. No. 4,899,823 to Cobb et al., entitled "Method and Apparatus for Running Coiled Tubing in Subsea Wells" and issued on Feb. 13, 1990, U.S. Pat. No. 5,022,130 to Laky, entitled "System for Handling Reeled Tubing" and issued on Mar. 26, 1991, and other documents referenced therein, all of which are hereby incorporated by reference herein in their entireties. However, the present disclosure and appended claims are not limited to or by these example types of equipment or the information provided in the referenced documents.

Still referring to FIG. 1, the injectors 22, 28 may be used in connection with any suitable equipment configuration for their effective deployment and use. In this embodiment, the coiled tubing 34 is shown spooled onto and off one or more tubing reel 36 mounted to the structure 16. At least one spooling device 40, such as a level wind assembly 42, may be included to spool the coiled tubing 34 in a loop (or arc) on and off the reel 36. If desired, a tubing feeder 44 may be disposed between the reel 36 and the surface injector 22. The illustrated tubing feeder 44 grips the tubing 32 and feeds it between the reel 36 and the surface injector 22. In this example, the feeder 44 is electronically controlled to manage the tubing 36 extending between itself and the surface injector 22 and to function in timed-operation with the surface injector 22. An inline pipe inspection device 49 is also included in this embodiment to inspect/monitor the condition of the tubing 32 before it is fed to the surface injector 22 and submerged in the water. An example pipe inspection device 49 is the presently commercially available PipeCheck System by BJ Services Company.

Figure 2:
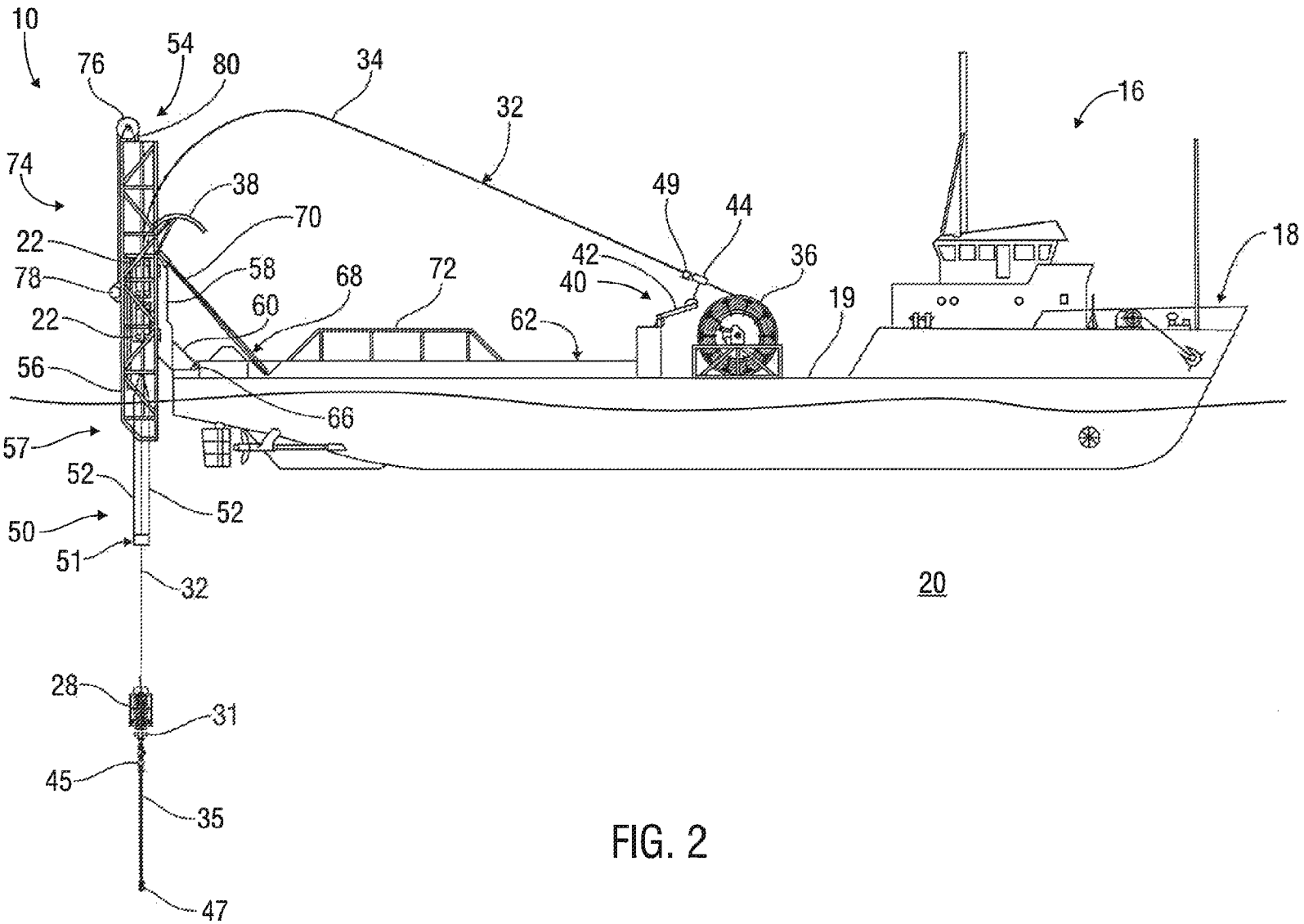
FIG. 2 is a side view of the waterborne vessel and tubing intervention system of FIG. 1 showing the exemplary carriage in a deployment position and the exemplary underwater injector submerged in the water in accordance with an embodiment of the present disclosure.

Referring now to FIG. 2, the tubing 32 is shown passing through the surface injector 22 from the tubing reel 36 and into and through the underwater injector 28. In this embodiment, a gooseneck 38 is included to support the tubing 32 in emergency situations. For example, the gooseneck 38 may be useful if the feeder 44 becomes unable to time the payout of the tubing 32 from the reel 36 with the speed of the surface injector 22. In such instance, it may be desirable wrap the tubing 32 over the gooseneck 38 as it is pulled out of the well and rewound back on the reel 36. However, in other embodiments, the gooseneck 38 or other equipment may be used to support the tubing 32 during normal or other particular operations. In some embodiments, a gooseneck 38 may not be included.

In another independent aspect of the present disclosure, a tubing catcher 50 may be included. The illustrated tubing catcher 50 is configured to engage or grab the tubing 32 if the tubing 32 breaks loose or otherwise becomes disengaged from the surface injector 22, preventing the tubing 32 from falling to the sea floor. The tubing catcher 50 may have any suitable configuration, components and operation. For example, the tubing catcher 50 may include at least one tapered slip 51 suspended from multiple wire 52. In this example, two slips 51 are included. The illustrated slips 51 are powered by an independent hydraulic charge pressure system (not shown) and electronically actuated, such as via hard wire or acoustic signal. If the tubing 32 comes loose above the tubing catcher 50, the slips 51 will be actuated to grab the tubing 32. In this example, the tubing catcher 50 is designed to hold up to approximately 150,000 lbs. of force. However, other embodiments may not include a tubing catcher 50.

Still referring to FIG. 2, the illustrated underwater injector 28 and equipment engaged therewith (such as described below) are configured to be deployed to the subsea well via the tubing 32 and releasably engaged with equipment (not shown) located at the well. The tubing 32 thus serves as a hoist for the exemplary underwater injector 28 and equipment deployed therewith without the necessity of a separate cable winch, crane or similar equipment. In the illustrated embodiment, the tubing 32, injector 28 and related equipment are shown being deployed off of the back of the vessel 18, but could instead be deployed over the side of the structure 16, through a moonpool (not shown) or in any other desired arrangement. In addition, the tubing 32 is deployed to the well without the use of risers extending from the structure 16 to the well. However, the tubing 32, underwater injector 28 and related equipment may be configured to be deployed to the well in any other suitable manner.

Figure 3:
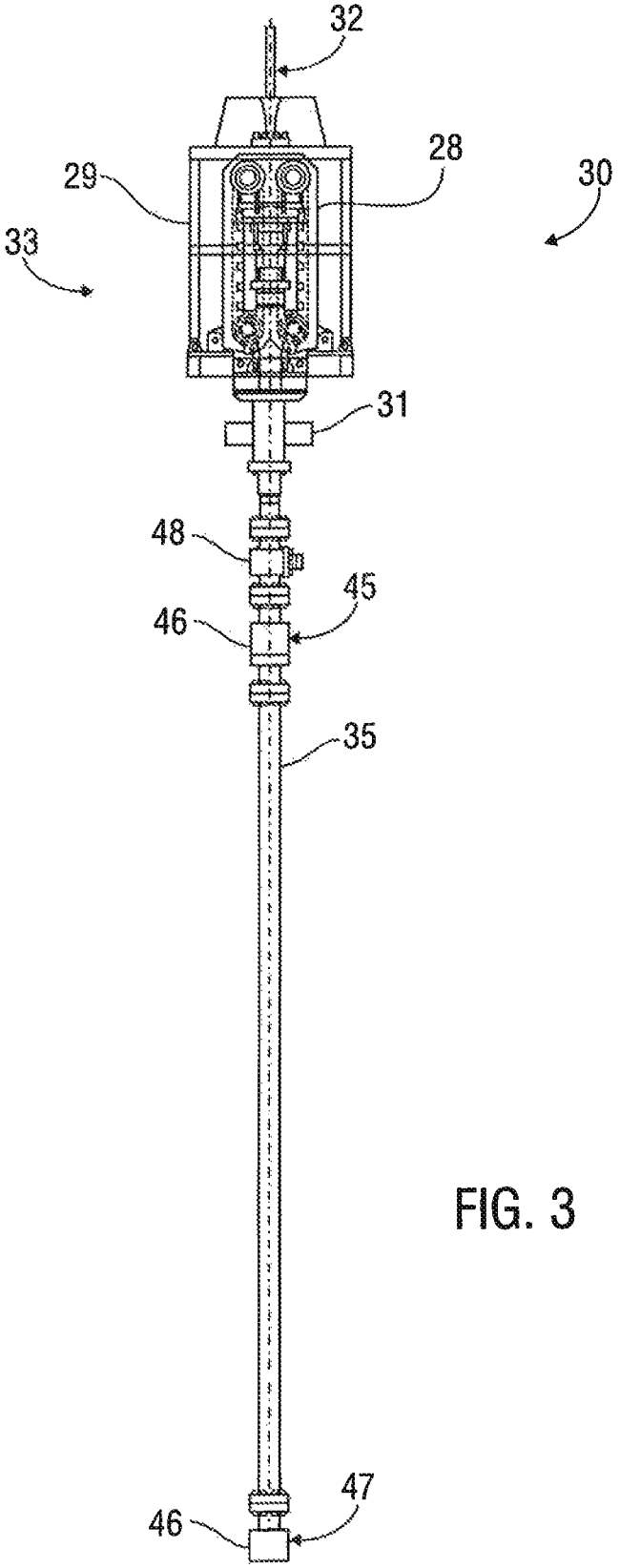
FIG. 3 is an exploded view of the exemplary underwater injector and associated equipment of FIG. 2.

Now referring to FIG. 3, in the present embodiment, the underwater injector 28 is housed in a frame 29 as part of an underwater injector assembly 30. Engaged below the illustrated injector 28 is a stripper 31, which provides a dynamic seal around the tubing 32 as it is run into and out of the well during operations, as is and becomes further known. A lubricator 35 is engaged below the stripper 31 and is releasably connectable to equipment (e.g. blowout preventer) located at the well (not shown). The lubricator 35 serves as a pressure vessel when engaged with equipment at the well, as is and becomes further known. In this embodiment, the lubricator 35 is short, such as 15-50' in length. However, the lubricator 35 may have any desired length, form and configuration.

Still referring to FIG. 3, the tubing 32 extends through the injector 28 and into the stripper 31. The bottomhole assembly or other equipment (not shown) that may be carried on the lower end 33 of the tubing 32 is positioned within the lubricator 35 during transport, delivery and deployment to/from the well. A first releasable coupling 45, such as a hydraulic quick connect 46, is shown disposed between the illustrated stripper 31 and lubricator 35. This may be useful, for example, to allow disengagement of the stripper 31 and lubricator 35 on the structure 16, such as to allow access to or change out of the bottomhole assembly (not shown) or other desired purpose. A second releasable coupling 47 is shown disposed at the lower end of the lubricator 35 for engagement with/release from equipment (e.g. blowout preventer) at the well. If desired, a flow tee 48 may be engaged below the stripper 31, such as to allow the recovery or venting of fluids from the lubricator 35 after connection with equipment at the well, as is and becomes further known. In this embodiment, the stripper 31, lubricator 35, couplings 45, 47 and flow tee 48 are deployed and retrieved with the underwater injector 28 via the tubing 32.

Referring back to FIG. 1, in another independent aspect of the present disclosure, the injectors 22, 28 of this embodiment are shown carried within a mast assembly 54. However, any other suitable equipment for carrying the injectors 22, 28 may be used. In this example, the mast assembly 54 includes a carriage 56 that houses the surface injector(s) 22 and carries the underwater injector 28. The surface injectors 22 are mounted to the carriage 56, while the underwater injector 28 is movable into and out of the carriage 56. The exemplary carriage 56 is self-erecting and foldable between at least one "transport position" (e.g. FIG. 1) and at least one "deployment position" (e.g. FIG. 2).

In a transport position (e.g. FIG. 1), the illustrated carriage 56 is shown substantially horizontal relative to the vessel deck 19. When the exemplary carriage 56 is in this position, the mast assembly 54 and all components carried thereby have a low center of gravity, enhancing stability of the structure 16, such as during transport. The transport position may also allow secure positioning and enhanced safety in the handling of the injectors 22, 28 and other equipment on the structure 16, such as during transport, maintenance, inspection, repair, replacement, etc. For example, the transport position of the carriage 56 may improve ease of and safety when accessing or changing out the bottomhole assembly (not shown) engaged on the tubing 32. In this position of the carriage 56, the illustrated mast assembly 54 provides a work platform at a sensible height and eliminates the need for deck cranes or other equipment otherwise needed to replace the bottomhole assembly (not shown). The transport position of the exemplary carriage 56 also ensures no part of the tubing intervention system 10 or related equipment are trailing in the water, such as when the system 10 is not deployed or the vessel 18 (or other structure 16) is in transit.

In a deployment position (e.g. FIG. 2), the carriage 56 of this embodiment is shown substantially vertical relative to the vessel deck 19 with its lower end 57 submerged in the water. The illustrated deployment position allows deployment of the tubing 32, underwater injector 28 and associated equipment to the well and operation of the tubing intervention system 10. In this example, when the carriage 56 is in this position, the mast assembly 54 and components carried thereby also have a low center of gravity, enhancing stability of the structure 16 during operations.

The exemplary carriage 56 may be moveable between transport and deployment positions in any suitable manner. In this embodiment, the carriage 56 is pivotably movable relative to the vessel 18. Referring to FIG. 2, the illustrated carriage 56 is carried on a carriage base 58, which pivots relative to a mast platform 62. For example, the carriage base 58 may have a protruding arm 60 that pivotably engages the mast platform 62, such as via a pivot shaft 66. The mast platform 62 is shown firmly secured to the vessel deck 19, such as with bolts. A carriage driver 68 is shown extending between the mast platform 62 and the carriage 56 (and/or carriage base 58) and is selectively controlled to move the carriage 56 between positions. For example, the carriage driver 68 may include at least one hydraulic cylinder 70. It should be noted that there may be multiple of the aforementioned components as needed or desired in a particular embodiment to adequately support the mast assembly 54, tubing 32, injectors 22, 28 and other equipment throughout transportation and operations. Moreover, different or additional components may be included in the mast assembly 54.

In this embodiment, the carriage 56 is also selectively movable relative to the carriage base 58 between multiple positions. For example, a lower (lateral) position of the carriage 56 relative to the carriage base 58 (e.g. FIG. 2) allows the lower end 57 of the carriage 56 to be suitably submerged in the water for deployment of the underwater injector 28 and operation of the tubing intervention system 10. An upper (lateral) position of the exemplary carriage 56 relative to the carriage base 58 (e.g. FIG. 1) is useful for positioning the carriage 56 in a transport position, such as upon a deck base 72 that extends upwardly from the mast platform 62. The carriage 56 may be movable relative to the carriage base 58 in any suitable manner. For example, one or more manual or electronically controlled chain drive assembly (not shown) may be used.

Referring again to FIG. 2, in another independent aspect of the present disclosure, the tubing intervention system 10 of this embodiment is heave-compensated, such as to effectively isolate the tubing 32 from movement of the structure 16 in the water. This may be accomplished in any suitable manner. For example, the carriage 56 may be heave-compensated in the mast assembly 54 to compensation for all motions of the vessel 18 in the water. In the illustrated embodiment, an active heave compensation system 74 includes at least one pulley 76 and winch 78 mounted on the carriage 56. At least one carrier line 80 extends from the winch 78, over the pulley 76 and to the surface injector(s) 22, suspending the surface injector 22 within the carriage 56. As the structure 16 moves up and down, side-to-side and in any other manner in the water (relative to the sea floor), the illustrated system 74 responsively varies the suspension height of the surface injector(s) 22 within the carriage 56, generally maintaining the position of the tubing 32 relative to the sea floor. The exemplary heave compensation arrangement may be useful, for example, to allow successful engagement/disengagement with the well and assist in avoiding undesirable jarring on the tubing 32 and/or underwater injector assembly 30 during deployment to and from the well and after engagement with the well. If desired, active or passive roll and pitch compensation may also be included.

For another example, the chains (not shown) of the surface injector(s) 22 may be configured to move up and down in anti-phase to the movement of the structure 16. Thus, the surface injector 22 may be designed and operated to provide a heave compensation function by directly compensating for motion of the structure 16. If desired, this arrangement may be used as a back-up to the aforementioned heave compensation system 74 or other heave compensation arrangement, such as to minimize the potential for additional fatigue on the tubing 32 caused thereby.

Figure 4:
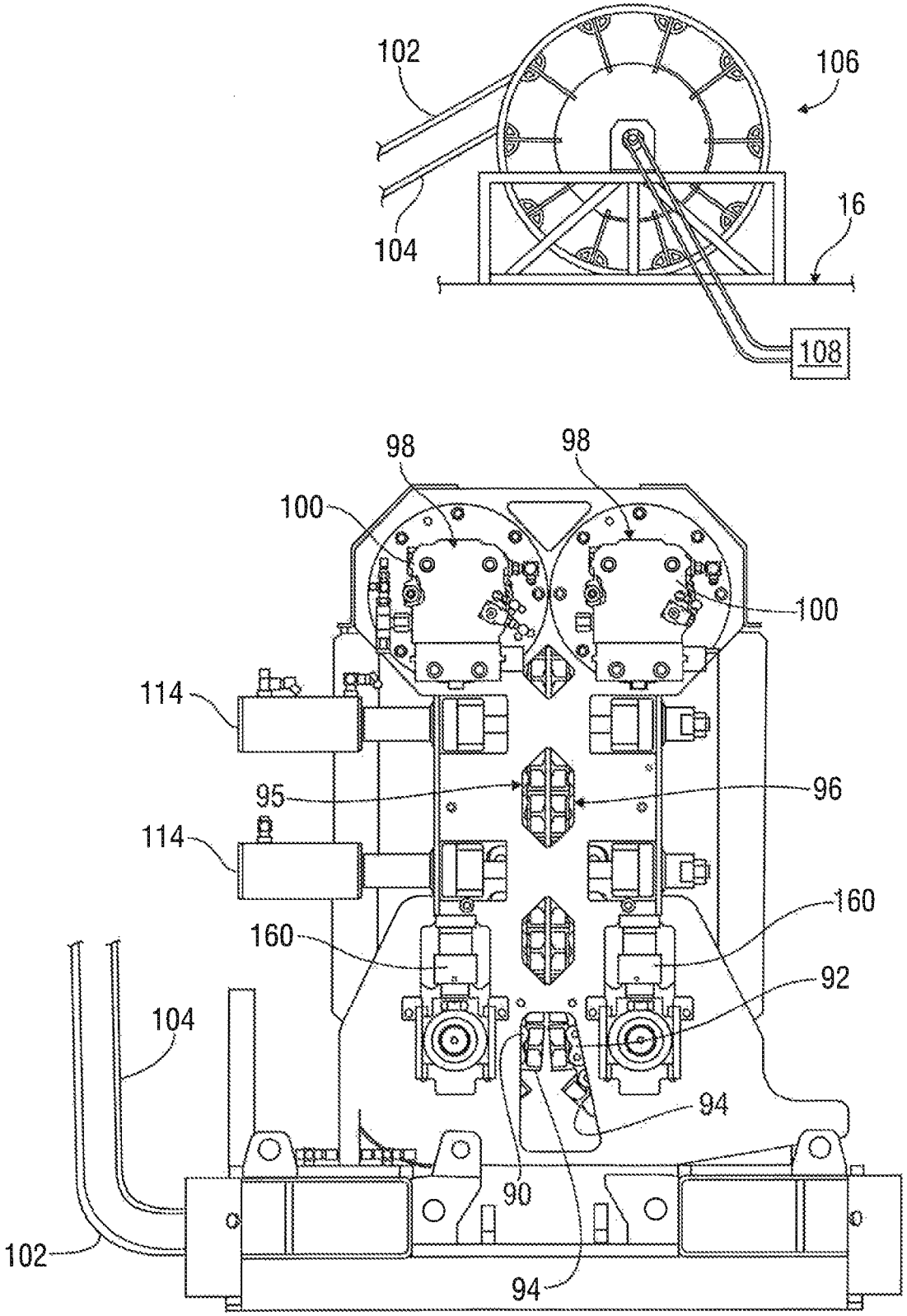
FIG. 4 is a side view of an embodiment of an underwater injector shown coupled to an umbilical reel with a pair of hydraulic control lines in accordance with an embodiment of the present disclosure.

FIG. 4 illustrates an example underwater injector 28 which may be used in connection with some embodiments of the present disclosure. In this example, the injector 28 possesses a low tubing push/pull power capacity and provides low traction force on the tubing 32 as compared to the surface injector 22. Consequently, the illustrated injector 28 is relatively simple and lightweight, smaller than the surface injector 22 and easy to move up and down to and from the well. Further, the underwater injector 28 may be arranged to have a tubing pushing capacity that is greater than its maximum tubing pulling capacity. In such instance, if desired, the underwater injector 28 may be a modified standard land injector unit arranged essentially upside down. For example, in some embodiments, an underwater injector 28 having a maximum pull capacity of 15,000 lbs. and maximum push capacity of 35,000 lbs. may be used a surface injector 22 having a pull rating of 80,000 lbs. However, the present disclosure is not limited to any of the suggested or exemplary injector power capacities.

The illustrated injector 28 includes a pair of opposing chains 90, 92 and corresponding blocks 94 which grip the tubing 32, as is and become further known. Each associated chain/block combination 90, 94 and 92, 94 is sometimes referred to herein as a chain/block assembly 95, 96, respectively. The exemplary chains 90, 92 are rotated by one or more chain rotation motors 98. When the chains 90, 92 are in suitable gripping engagement with the tubing 32, rotation of the chains 90, 92 by the motor(s) 98 will apply pushing and pulling forces to the tubing 32, as is and becomes further known.

In the embodiment of FIG. 4, two tandem-operating chain rotation motors 98 maintain a pre-set pull/pushing force upon the chains 90, 92. The chains 90, 92 will rotate in response to the speed of the tubing 32 as established by the surface injector 22 during normal operations. However, any desired number of (one or more) chain rotation motors 98 may be included.

The chain rotation motor 98 may have any suitable form, configuration and power capacity. In some embodiments, for example, the motors 98 may be electric. In the embodiment of FIG. 4, the chain rotation motors 98 are relatively low-power hydraulic motors 100. The illustrated motors 100 are driven by hydraulic fluid provided from the surface via a fluid circuit having hydraulic lines 102, 104 extending from an umbilical reel 106 disposed on the structure 16. However, there may be more than two hydraulic lines 102, 104. For example, two pairs of hydraulic lines may be used.

The lines 102, 104 may form a dedicated umbilical to the underwater injector 28 when deployed. Alternately, the lines 102, 104 may piggy-back onto an umbilical extending to other equipment at the well, such as a blowout preventer (not shown). The lines 102, 104 of this embodiment are bi-directional, so that either line 102, 104 may be used as the hydraulic supply or return line. In this example, because of the low power requirements of the motors 100, the lines 102, 104 may, if desired, be small, composite, near neutrally-buoyant hydraulic lines.

Still referring to FIG. 4, hydraulic fluid is supplied into and vented from the hydraulic lines 102, 104 of this embodiment with one or more hydraulic pump 108 disposed on the structure 16. If desired, one or more throttling valves (not shown) may be used in connection with the pump 108. In this example, the pump 108 is pre-set to run hydraulic fluid at a desired rate to maintain the pre-set pull/pushing force upon the chains 90, 92 previously described. If desired, the exemplary pump 108 may be manually adjusted into one or more additional phases of operation. For example, in this embodiment, an operator can shift the pump 108 into second position for increased power to the motors 100, such as for snubbing the tubing 32 into the well, and a third "off" position. Thus, the illustrated pump 108 and motors 98 are controlled independent of the surface injector 22. Additionally, in this embodiment, the phase adjustment of the pump 108 is the only function of the deployed underwater injector 28 adjustable from surface. Accordingly, control of the exemplary underwater injector 28 is not tied to the control of the surface injector 22 and operates completely independently therefrom.

The illustrated underwater injector 28 also includes one or more traction cylinders 114 for maintaining the blocks 94 in the desired gripping engagement with the tubing (not shown). This embodiment includes two traction cylinders 114. However, any desired quantity of traction cylinders 114 may be included. The illustrated traction cylinders 114 are energized to maintain the desired gripping engagement via an ambient pressure compensation system 116. If desired, the system 116 may be self-energized and self-contained, not requiring any control from the surface or fluid, electric or other communication with the surface. However, in other embodiments, the traction cylinders 114 may be energized in any suitable manner.

Figure 5:
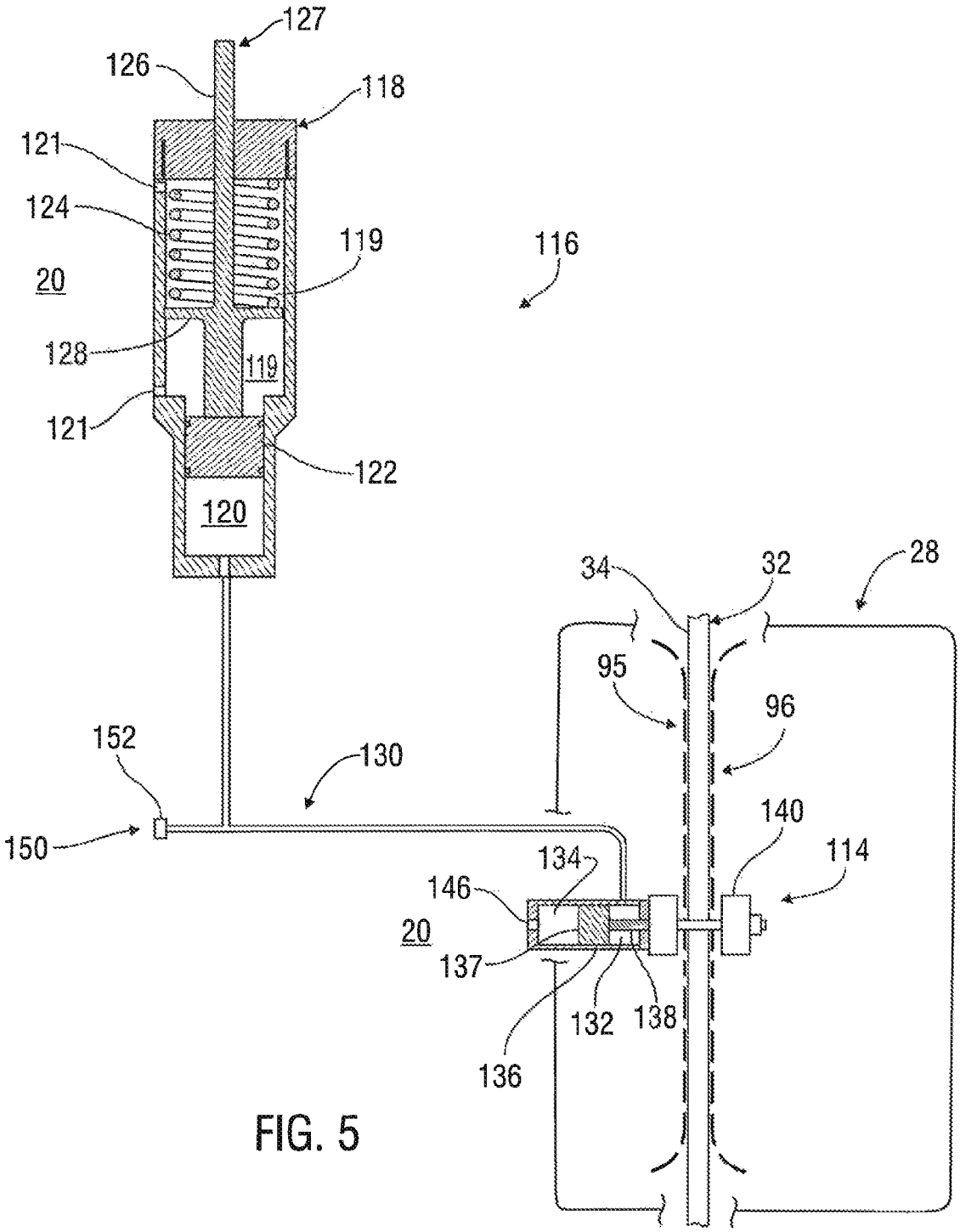
FIG. 5 is a partial cross-sectional and partial schematic view of an embodiment of an ambient pressure compensation system for energizing a chain traction cylinder of a underwater injector in accordance with an embodiment of the present disclosure.

Referring now to FIG. 5, the ambient pressure compensation system 116 may have any desired components, configuration and operation. In this embodiment, the system 116 includes a reservoir housing 118 associated with, or carried upon, the underwater injector assembly (e.g. assembly 30, FIG. 3), and having no hydraulic fluid flow lines or other communication lines to the surface. The illustrated housing 118 includes a biasing cavity 119 fluidly isolated from a reservoir cavity 120 by a reservoir piston 122. The reservoir piston 122 is spring-biased into the exemplary reservoir cavity 120 by one or more biasing element 124 disposed in the biasing cavity 119. The biasing element 124 may be one or more suitable spring or any other suitable biasing mechanism, as is or becomes further known.

Still referring to FIG. 5, the illustrated biasing element 124 extends around a shaft 126 of the reservoir piston 122 and applies force to a non-sealing extension 128 of the shaft 126. If desired, the end 127 of the shaft 126 may extend out of reservoir housing 118, such as to indicate the position of the piston 122 as may be detected by an ROV or other suitable equipment.

The exemplary reservoir cavity 120 contains hydraulic fluid in communication with a sealed first cavity 132 of the traction cylinder 114 via a sealed (pressurized) fluid circuit 130. Within the illustrated traction cylinder 114, a traction piston 136 separates the sealed first cavity 132 from a second cavity 134. The pressurized fluid circuit 130 thus extends between the reservoir piston 122 and the fraction piston 136.

Still referring to FIG. 5, the shaft 138 of the illustrated traction piston 136 engages an outer traction applicator 140, which effectively pulls the chain/block assembly 96 into gripping engagement with the tubing 32. Accordingly, pressure in the exemplary circuit 130 (caused by the biasing element 124 acting on the reservoir piston 122) biases the traction piston 136 away from the tubing 32, pulling the applicator 140 toward the tubing 32 and an inner traction applicator 142. Sufficient pressure in the circuit 130 will cause the outer traction applicator 140 to effectively sandwich the tubing 32 between the chain/block assemblies 95, 96 with the desired gripping forces. Thus, the illustrated biasing element(s) 124 may be pre-selected to cause the desired gripping forces on the tubing 32. However, any other configuration of components for pressurizing the circuit 130 and causing gripping engagement of the tubing 32 may be used.

If desired, gripping forces on the tubing 32 may be maintained in the underwater injector 28 regardless of the ambient (hydrostatic) fluid pressure in the surrounding water body 20. Any suitable component arrangement may be used to compensate for changes in ambient pressure. For example, in the illustrated embodiment, the ambient pressure (sea water) is communicated to the biasing cavity 119 of the reservoir housing 118 and the second cavity 134 of the traction cylinder 114 through ports 121, 146, respectively. Thus, changes in ambient pressure are effectively ported to both sides of the traction piston 136, preserving the pressurized state of the circuit 130 caused by the biasing forces of the biasing element 124.

Still referring to FIG. 5, it may be desirable to maintain traction forces on the tubing 32 in the underwater injector 28 regardless of changes in the outer diameter (OD) of the tubing 32. Any suitable arrangement and techniques may be used to preserve the gripping engagement of the chain/block assemblies 95, 96 with the tubing 32 upon variations in the OD of the tubing 32. In the illustrated embodiment, the use of the biasing element(s) 124 and venting on opposite sides of the system 116 (via ports 121 in the biasing cavity 119 and ports 146 in the second cavity 134) may allow shifting of the fraction piston 136 in either direction in response to OD changes in the tubing 32. For example, upon an increase in the OD of the tubing 32 as it passes through the chain/block assemblies 95, 96, the traction piston 136 may slide into the first cavity 132 of the fraction cylinder 114, maintaining suitable traction pressure on the tubing 32. This action may apply pressure to the reservoir piston 122, compressing the biasing element 124 and/or forcing sea water out of the biasing cavity 119 through the port(s) 121. For another example, upon a decrease in the OD of the tubing 32, the traction piston 136 may slide into the second cavity 134, forcing sea water to exit the second cavity 134 through the port(s) 146 and maintaining suitable traction pressure on the tubing 32.

The ambient pressure compensation system 116 may include a vent 150 in the fluid circuit 130, such as to allow pressure on the traction piston 136 to be released, provide additional hydraulic fluid into the reservoir cavity 120 or other purpose. For example, a valve 152 may be disposed at the vent 150 and accessible by a ROV or other equipment. The valve 152 may be opened to the water body 20 or a hydraulic fluid receptacle or line (not shown), such as to release pressure in the ambient pressure compensation system 116 and disengage the chain/block assemblies 95, 96 and underwater injector 28 from the tubing 32. This sequence may be desirable, for example, in the instance of an equipment malfunction, total system failure, tubing seize-up, etc.

Referring back to FIG. 4, the exemplary underwater injector 28 also includes one or more chain tension cylinders 160. The chain tension cylinders 160 may have any suitable configuration and operation, as is or becomes further known. In this embodiment, each chain 90, 92 has a dedicated chain tension cylinder 160, which maintains a desired tension on the corresponding chain 90, 92 by acting upon a lower sprocket (not shown) engaged with the respective chain 90, 92. The chain tension cylinders 160 may be energized to maintain the desired chain tension in any desired manner. For example, an ambient pressure compensation system generally similar to the system 116 as described above may be used to energize each chain tension cylinder 160. For another example, the chain tension cylinders 160 may be mechanically or spring energized, as is or becomes further known. The underwater injector 28 may include other systems or features, such as gear box oil and case drain, as are and become further known. If desired, any among these systems may likewise be energized by an ambient pressure compensation system generally configured similar to the system 116 as described above.

In some embodiments, water-based hydraulic fluids (WBHF) may be used with one or more of the hydraulic components of the underwater injector 28. For example, the use of WBHF with the underwater injector 28 may allow a closer hydrostatic balance between the water body 20 and the WBHF in the injector 28 and/or its associated components (as compared to the use of oil-based hydraulic fluids). For another example, environmentally certified WBHF may be leaked or vented into the water body 20 from the subsea injector 28 or related equipment, reducing the risk of environmental damage and removing the need for an underwater case drain line (not shown) extending to the structure 16. For yet another example, the use of WBHF in connection with WBHF-compatible motors (e.g. motor 100) of the injector 28 may reduce the risk of motor collapse pressure situations that could arise due to a potential pressure differential between the fluid in the motor and the ambient pressure in the water body 20, such as when the motor is not powered.

If desired, the exemplary underwater injector 28 may be configured without any instrumentation requiring monitoring from the surface. For example, any necessary gauge(s) and/or sensor(s) (not shown) to monitor hydraulic pressure and flow rate in the lines 102, 104 may be disposed at the upper end of the lines 102, 104 or on the structure 16. Any other necessary gages, sensors or other instrumentation for the injector 28, such as for use with the motors 98, traction cylinders 114, chain tension cylinders 160, ambient pressure compensation system(s) 116, gear box oil (not shown), case drain (not shown) or other components, may be configured to be monitorable by an ROV or equipment. Accordingly, the instrumentation associated with the underwater injector 28 may be relatively simple, reducing the complexity of the injector assembly 30, the potential for malfunction or requirement for electrical or other communication from the surface. The exemplary tubing intervention system 10 may thus be run by operators with minimal special training.

In another independent aspect, the present invention includes methods of providing tubing 32 into a subsea well from a floating structure 16 without the use of one or more risers. An embodiment of a method will now be described in connection with the use of the tubing intervention system 10 and example components of FIGS. 1-5. However, it should be understood that the illustrated system 10 is not required for practicing this exemplary method or other methods of the present disclosure or appended claims. Any suitable components may be used. Further, the present disclosure is not limited to the particular method described below, but includes various method in accordance with the principals of the present disclosure.

Referring to the example of FIGS. 1 and 2, a first end 33 of the tubing 32 is extended through the surface (master) injector(s) 22 and into the underwater (slave) injector 28, which is suspended therefrom. For example, referring to FIG. 3, the end 33 of the tubing 32 may be extended into the stripper 31 and coupled to a bottomhole assembly (not shown) disposed in the lubricator 35. The stripper 31 and lubricator 35 may be releasably connected, such as with the coupling 45. If the exemplary self-erecting mast assembly 54 is included, the carriage 56 may be in a substantially horizontal position during connection of the equipment as described above (as well as during transport, maintenance, change-out of equipment, etc). For deployment of the underwater injector 28 and tubing 32 to the well, the illustrated carriage 56 is moved to a substantially vertical position and partially submerged in the water. If desired, the mast assembly 54 or other component(s) (e.g. surface injector 22) may be configured to heave-compensate for the motion of the structure 16 in the water.

The exemplary underwater injector 28 and related equipment (e.g. FIG. 3) are delivered to the well by lowering the tubing 32 into the water (e.g. FIG. 2). In this embodiment, the underwater injector 28 may be lowered to the well without the use of a hoist, cable winch or crane on the structure 16. Further, the illustrated structure 16 need not be a specialized vessel, as long as it is capable of holding and supporting the system 10 and related equipment.

After the illustrated underwater injector 28 is engaged with the well, the surface injector 22 is selectively operated to control movement of the tubing 32 up and down in the well, as desired. The underwater injector 28 applies downwardly-directed pushing forces or upwardly-directed pulling forces to the tubing 32, as desired, without controlling the movement of the tubing 32.

The exemplary underwater injector 28 is controlled independently of the surface injector 22 and may be pre-set to operate substantially automatically. For example, the injector 28 may have some operator control or adjustability from surface to increase or decrease its tubing push and/or pull capacity, such as to facilitate snubbing the tubing 32 into the well, replacing a sub-surface safety valve (not shown), etc. If desired, the underwater injector 28 may be configured without any gages, sensors or other instrumentation requiring monitoring from the surface. Also, if desired, the underwater injector 28 may be energized with water-based hydraulic fluid.

Referring now to FIG. 4, in this example method of operation, a total of only two communication lines are extended between the subsea injector 28 and the structure 16. For example, the hydraulic fluid control lines 102, 104 are included to energize the chain rotation motors 100 of the underwater injector 28. The lines 102, 104 may be connected to the injector 28 before deployment from the structure 16 or connected at the sea floor with remote equipment, such as an ROV. The underwater injector 28 may be equipped with at least one chain traction cylinder 114 that maintains the injector 28 in gripping engagement with the tubing, regardless of changes in the ambient pressure in the sea water or the outer diameter of the tubing 32. If desired, at least one self-contained, self-powered and spring-energized ambient pressure compensation system 116 (e.g. FIG. 5) may be included for providing at least one among chain traction pressure control, chain tension control, gear box oil and case drain control in the underwater injector 28, without any control lines extending to the vessel or surface.

Referring back to FIG. 2, in this example method of operation, the underwater injector 28 may be selectively released from the well, returned to the structure 16 by retracting the tubing 32 onto the structure 16, returned to the well by redeployment of the tubing 32 and reengaged with the well multiple times as desired, without the use of a cable winch, crane or hoist.

Preferred embodiments of the present disclosure thus offer advantages over the prior art and are well adapted to carry out one or more of the objects of this disclosure. However, the present disclosure does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and claims.

The methods that are provided in or apparent from this disclosure or claimed herein, and any other methods which may fall within the scope of the appended claims, may be performed in any desired suitable order and are not necessarily limited to any sequence described herein or as may be listed in the appended claims. Further, the methods of the present disclosure do not necessarily require use of the particular embodiments shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant, within the scope of the appended claims, and may be made and used by one of ordinary skill in the art without departing from the spirit or teachings of the disclosure and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus for injecting tubing from a structure located proximate to the surface of a body of water into a well extending into the earth below the water and sea floor, the apparatus comprising:

at least one surface injector associated with the structure, engaged with the tubing and positionable proximate to the surface of the water, said surface injector being adapted and arranged to control the movement of the tubing into and out of the underground well below the sea floor during normal operations; and at least one underwater injector engaged with the tubing, deliverable on the tubing from the structure to the well, releasably engageable with the well and being arranged and adapted to apply limited downwardly-directed pushing forces and limited upwardly-directed pulling forces to the tubing, said at least one underwater injector being arranged and adapted to be delivered on the tubing to the well without the use of one or more risers extending from the structure to the well, wherein at least one among said at least one surface injector and said at least one underwater injector is arranged and adapted to maintain the tubing in substantial tension between said at least one surface injector and said at least one underwater injector, further wherein said at least one underwater injector is configured to apply and applies only such downwardly-directed pushing force to the tubing as is necessary during operations to overcome wellhead pressure and well friction occurring when inserting the tubing into the well and to maintain tension on the tubing above said at least one underwater injector.

2. The apparatus of claim 1 wherein said at least one underwater injector is controlled independently of said at least one surface injector.

3. The apparatus of claim 2 wherein said at least one underwater injector operates at least substantially automatically.

4. The apparatus of claim 2 wherein said at least one underwater injector is configured without any gages, sensors or other instrumentation requiring connection to or monitoring from the structure.

5. The apparatus of claim 1 wherein each said surface injector and each said underwater injector have a known weight, respectively, and wherein said weight of each said underwater injector is less than said weight of each said surface injector.

6. The apparatus of claim 1 wherein said at least one underwater injector includes at least two chain/block assemblies configured to grip the tubing and be rotated to push and pull the tubing.

7. The apparatus of claim 6 further including at least one chain rotation motor, said at least one chain rotation motor configured to maintain a pre-set force upon said at least two chain/block assemblies.

8. The apparatus of claim 7 wherein said at least one chain rotation motor is energized with water-based hydraulic fluid, whereby a risk of motor collapse pressure situations due to a potential pressure differential between the fluid within said at least one chain rotation motor and the ambient pressure in the body of water is reduced.

9. The apparatus of claim 7 further including only first and second hydraulic fluid control lines extending from the structure to said at least one underwater injector, said first and second hydraulic fluid lines engaged with and used to energize said at least one chain rotation motor, wherein said at least one underwater injector requires no other hydraulic, electric or other lines extending to the structure or surface.

10. The apparatus of claim 6 further including at least one chain traction cylinder configured to maintain said at least two chain/block assemblies in gripping engagement with the tubing regardless of changes in the ambient pressure in the water body acting upon said at least one underwater injector.

11. Apparatus for injecting tubing from a structure located proximate to the surface of a body of water into a well extending into the earth below the water and sea floor, the apparatus comprising:

at least one surface injector associated with the structure, engaged with the tubing and positionable proximate to the surface of the water, said surface injector being adapted and arranged to control the movement of the tubing into and out of the underground well below the sea floor during normal operations; and at least one underwater injector engaged with the tubing, deliverable on the tubing from the structure to the well, releasably engageable with the well and being arranged and adapted to apply limited downwardly-directed pushing forces and limited upwardly-directed pulling forces to the tubing, said at least one underwater injector being arranged and adapted to be delivered on the tubing to the well without the use of one or more risers extending from the structure to the well, wherein at least one among said at least one surface injector and said at least one underwater injector is arranged and adapted to maintain the tubing in substantial tension between said at least one surface injector and said at least one underwater injector, wherein said at least one underwater injector is configured to apply and applies only such upwardly-directed pulling force to the tubing as is necessary to overcome the weight of the tubing above said at least one underwater injector when removing the tubing from the well.

12. The apparatus of claim 11 wherein said at least one underwater injector is controlled independently of said at least one surface injector.

13. The apparatus of claim 12 wherein said at least one underwater injector operates at least substantially automatically.

14. Apparatus for providing coiled tubing into a subsea hydrocarbon production well from a waterborne vessel on the surface of the sea, the well extending into the earth below the water and sea floor, the apparatus comprising:

at least one master injector carried by the vessel, having a known weight, being positionable proximate to the surface of the water and engaged with the coiled tubing, said master injector being arranged and adapted to direct the movement of the tubing into and out of the underground well below the sea floor during normal operations; and at least one slave injector engaged with the coiled tubing, deliverable on the coiled tubing from the vessel to the well and configured to be repeatedly deployable to and from the well, each said slave injector having a weight that is less than the weight of each said master injector and being configured to be delivered to the well on the coiled tubing without the use of one or more risers extending from the vessel to the well, wherein at least one among said at least one master injector and said at least one slave injector is arranged and adapted to maintain the tubing in substantial tension between said at least one master injector and said at least one slave injector.

15. The apparatus of claim 14 further including a self-erecting mast disposed on the vessel and within which said at least one master injector is carried, at least part of said self-erecting mast being movable between multiple positions, at least one said position allowing for the deployment of said at least one slave injector and coiled tubing to the well and at least one other said position allowing for handling, maintenance and change-out of said at least one slave injector and components related thereto.

16. Apparatus for providing coiled tubing into a subsea hydrocarbon production well from a waterborne vessel on the surface of the sea, the well extending into the earth below the water and sea floor, the apparatus comprising:

at least one master injector carried by the vessel, positionable proximate to the surface of the water and engaged with the coiled tubing, said master injector being configured to be operated at a known operating power level and arranged and adapted to alone control movement of the coiled tubing into and out of the underground well below the sea floor; and at least one slave injector engaged with the coiled tubing and adapted and arranged to be delivered on the coiled tubing from the vessel to the well without the use of any risers extending from the vessel to the well, each said slave injector being configured to be operated at a power level that is less than approximately one-half of the operating power level of each said at least one master injector.

17. A method of providing tubing into a subsea well from a floating structure, the well extending into the earth below the water and sea floor, the method comprising:

extending a first end of the tubing through at least one master injector carried on the structure, each master injector having a known weight;

at the first end of the tubing, suspending at least one slave injector having a weight that is less than the weight of each master injector;

delivering the at least one slave injector to the well by lowering the tubing into the water without the use of one or more risers extending from the structure to the well;

engaging the at least one slave injector with the well;

maintaining tension on the tubing between the at least one master injector and the at least one slave injector; and selectively operating the at least one master injector to control movement of the tubing into and out of the underground well below the sea floor.

18. The method of claim 17 further including the at least one slave injector applying downwardly-directed pushing forces and upwardly-directed pulling forces to the tubing without the at least one slave injector controlling the movement of the tubing.

19. The method of claim 18 further including configuring the at least one slave injector to be controlled independently of the at least one master injector.

20. The method of claim 19 further including configuring the at least one slave injector to be pre-set to operate automatically.

21. The method of claim 17 further including extending only first and second hydraulic fluid control lines to the at least one slave injector for energizing at least one chain rotation motor of the at least one slave injector, wherein the at least one slave injector requires no other hydraulic, electric or other lines extending to the structure or surface.

22. The method of claim 21 further including configuring the at least one slave injector with at least one chain traction cylinder that automatically maintains the at least one slave injector in gripping engagement with the tubing regardless of changes in the ambient pressure in the sea water and changes in the outer diameter of the tubing.

23. The method of claim 17 further including lowering the tubing and at least one slave injector to the well without the use of a hoist, cable winch or crane.

24. The method of claim 17 further including providing a self-erecting mast on the structure and within which the at least one master injector is carried, moving at least part of the self-erecting mast between multiple positions, at least one position allowing for deployment of the at least one slave injector and tubing to the well and at least one other position allowing for the transport, handling, maintenance and change-out of the at least one slave injector, components related thereto and equipment carried on the first end of the tubing.

25. The method of claim 24 further including selectively releasing the at least one slave injector from the well, returning it to the structure by retracting the tubing onto the structure, returning the at least one slave injector to the well by re-deploying the tubing from the structure and reengaging the at least one slave injector with the well multiple times without the use of a cable winch, hoist or crane.

* * * * *